US006178247B1

(12) United States Patent
Ogita

(10) Patent No.: US 6,178,247 B1
(45) Date of Patent: Jan. 23, 2001

(54) HEADPHONE APPARATUS

(75) Inventor: Kazuaki Ogita, Nabari (JP)

(73) Assignee: Yugengaisha Ito Denkitekkousyo, Mie-Ken (JP)

( * ) Notice: Under 35 U.S.C. 154(b), the term of this patent shall be extended for 0 days.

(21) Appl. No.: 09/000,349

(22) PCT Filed: Jul. 17, 1996

(86) PCT No.: PCT/JP96/01992

§ 371 Date: Apr. 23, 1998

§ 102(e) Date: Apr. 23, 1998

(87) PCT Pub. No.: WO97/04620

PCT Pub. Date: Feb. 6, 1997

(30) Foreign Application Priority Data

Jul. 17, 1996 (JP) ..... 7-180016

(51) Int. Cl.[7] ..... H04R 1/10
(52) U.S. Cl. ..... 381/74; 381/309
(58) Field of Search ..... 381/74, 309, 310, 381/17, 1, 370, 386

(56) References Cited

U.S. PATENT DOCUMENTS 4,136,260 * 1/1979 Asahi ..... 381/310
4,589,128 * 5/1986 Pfleiderer ..... 381/310

FOREIGN PATENT DOCUMENTS 52-11002 * 1/1977 (JP) ..... 381/74
3-250900 11/1991 (JP) ..... 381/74

* cited by examiner

*Primary Examiner*—Minsun Oh Harvey
(74) *Attorney, Agent, or Firm*—Wenderoth, Lind & Ponack, L.L.P.

(57) ABSTRACT

First and second direct sound generator circuits 3*a* and 3*b* generate direct sound audio signals corresponding to a sound which travels from an imaginary sound source R and reaches directly to the user's ears. When distances from the imaginary sound source R to the left and right ears are different from each other, the generated audio signals are made to have a specified delay time between the first and second direct sound generator circuits 3*a* and 3*b*. First and second reflection sound generator circuits 4*a* and 4*b* generate reflection sound audio signals corresponding to a sound which travels from the imaginary sound source R and reaches the ears after being once reflected on the user's shoulder. The reflection sound audio signals are delayed by a specified delay time, respectively, from the corresponding direct sound audio signals. Summing amplifiers 7*a* and 7*b* combine the direct sound audio signals with the reflection sound audio signals for the left and right ears and reproduce the resulting signals independently at left and right headphones 8*a* and 8*b*.

16 Claims, 4 Drawing Sheets

HEADPHONE APPARATUS

TECHNICAL FIELD

The present invention relates to a headphone apparatus, and in particular, to a headphone apparatus which has an excellent extra-head localization effect of its acoustic image (imaginary sound source).

BACKGROUND ART

Conventionally, headphone apparatuses have had the problem that they give an unnatural feeling as well as a feeling of fatigue to the listener because an acoustic image produced by audio signals outputted from left and right headphones are formed inside the head or near both ears which is different from the case where the audio signals are heard from speakers.

Accordingly, a variety of means have been proposed lately for the purpose of enabling the extra-head localization of the acoustic image. For example, a headphone apparatus disclosed in the document of Japanese Patent Laid-Open Publication No. HEI 3-250900 enables extra-head localization by taking reflection sounds which reach the ears through reflection on walls and the like into consideration, in addition to sounds which reach the ears directly.

However, even the aforementioned headphone apparatus still has an unnatural feeling in comparison with the case where sounds are heard from speakers or the like, and it has a problem particularly in the extra-head localization in the depthwise direction and the vertical direction. This is also apparently disadvantageous in considering the fact that we can obtain directivity of a sound even when listening to the sound from speakers in an anechoic room.

In view of the above, the present inventor has discovered that a reflection sound on the shoulder is an important factor in determining the directivity of a sound and obtaining an appropriate extra-head localization by taking into consideration how much the reflection sound is delayed on the shoulder relative to a direct sound.

SUMMARY OF THE INVENTION

That is, according to the present invention, there is provided a headphone apparatus comprising: a first direct sound generating means for generating a first direct sound audio signal corresponding to a sound which travels from an imaginary sound source and directly reaches one ear by delaying an input audio signal; a second direct sound generating means for generating a second direct sound audio signal corresponding to a sound which travels from the imaginary sound source and directly reaches the other ear by delaying the input audio signal; a first reflection sound generating means for generating a first reflection sound audio signal corresponding to a sound which travels from the imaginary sound source, reaches a shoulder and thereafter reaches the one ear through reflection by delaying the input audio signal; a second reflection sound generating means for generating a second reflection sound audio signal corresponding to a sound which travels from the imaginary sound source, reaches a shoulder and thereafter reaches the other ear through reflection by delaying the input audio signal; a first adding means for adding the first direct sound audio signal to the first reflection sound audio signal, thereby generating a first combined sound audio signal; a second adding means for adding the second direct sound audio signal to the second reflection sound audio signal, thereby generating a second combined sound audio signal; and headphones for reproducing the first combined sound audio signal from the first adding means and the second combined sound audio signal from the second adding means independently at left and right ears, respectively.

The aforementioned first and second direct sound generating means delay the input audio signal to make the direct sound audio signal corresponding to the sound which travels from the imaginary sound source and directly reaches the ears. When distances from the imaginary sound source to the left and right ears differ from each other, the phase of the audio signal to be outputted is shifted between the first and second direct sound generating means. With this arrangement, the position of the imaginary sound source can be localized in a lateral direction. The first and second reflection sound generating means delay the input audio signal to make the reflection sound audio signal corresponding to the sound which travels from the imaginary sound source, impinges once on the shoulder and thereafter reaches the ears. The reflection sound audio signals are respectively obtained by shifting the phases of the corresponding direct sound audio signals. The adding means combine the direct sound audio signals with the reflection sound audio signals for the left and right ears, and the resulting sounds are reproduced independently at left and right headphones. This arrangement enables the localization of the position of the imaginary sound source in a depthwise direction, thereby allowing sounds to have a greater expanse in the depthwise direction than with the prior art headphone apparatus.

It is acceptable to combine the generating means as one unit and provide a plurality of the units according to the number of imaginary sound sources. According to this arrangement, each of the aforementioned units delays the input audio signal so that audio signals corresponding to the direct sound and the reflection sound from the corresponding imaginary sound source can be obtained. Therefore, these audio signals are combined and reproduced by the headphone, and consequently the obtained imaginary sound sources are localized in a plurality of places, thereby allowing a concert-hall presence to be appreciated similar to that of, for example, a live performance of an orchestra.

It is acceptable to make the phase shift of the reflection sound audio signals adjustable relative to the direct sound audio signals. According to this arrangement, when the phase shift of the reflection sound audio signals relative to the direct sound audio signals is adjusted by changing the delay time, the obtained imaginary sound source can be localized not only in the lateral and depthwise directions, but also in a vertical direction.

It is acceptable to provide a sound pressure adjusting means for suppressing a sound pressure level of the audio signal generated by each of the direct sound generating means as the phase shift relative to the input audio signal increases between the direct sound generating means and the adding means. The sound pressure adjusting means may suppress the sound pressure level on a treble region side of the audio signal whose sound pressure level has been suppressed further than that on a bass region side. According to this arrangement, the aforementioned sound pressure adjusting means clarifies the direction of the imaginary sound source by suppressing the sound pressure level, or in particular, the sound pressure level on the treble region side of the generating means when a long delay time is set.

It is acceptable to provide a first diffraction sound generating means for generating a first diffraction sound audio signal corresponding to a sound which travels from a sound source and reaches the right ear through diffraction on a face by delaying the input audio signal and a second diffraction sound generating means for generating a second diffraction sound audio signal corresponding to a sound which travels from a sound source and reaches the left ear through diffraction on the face by delaying the input audio signal, make the first adding means add the first diffraction sound audio signal to the first direct sound audio signal and the first reflection sound audio signal and make the second adding means adding the second diffraction sound audio signal to the second direct sound audio signal and the second reflection sound audio signal. According to this arrangement, a more appropriate sound source direction can be obtained by taking the diffraction sound component on the face into consideration.

DETAILED DESCRIPTION OF THE INVENTION

Embodiments of the present invention will be described below with reference to the accompanying drawings.

Figure 1:
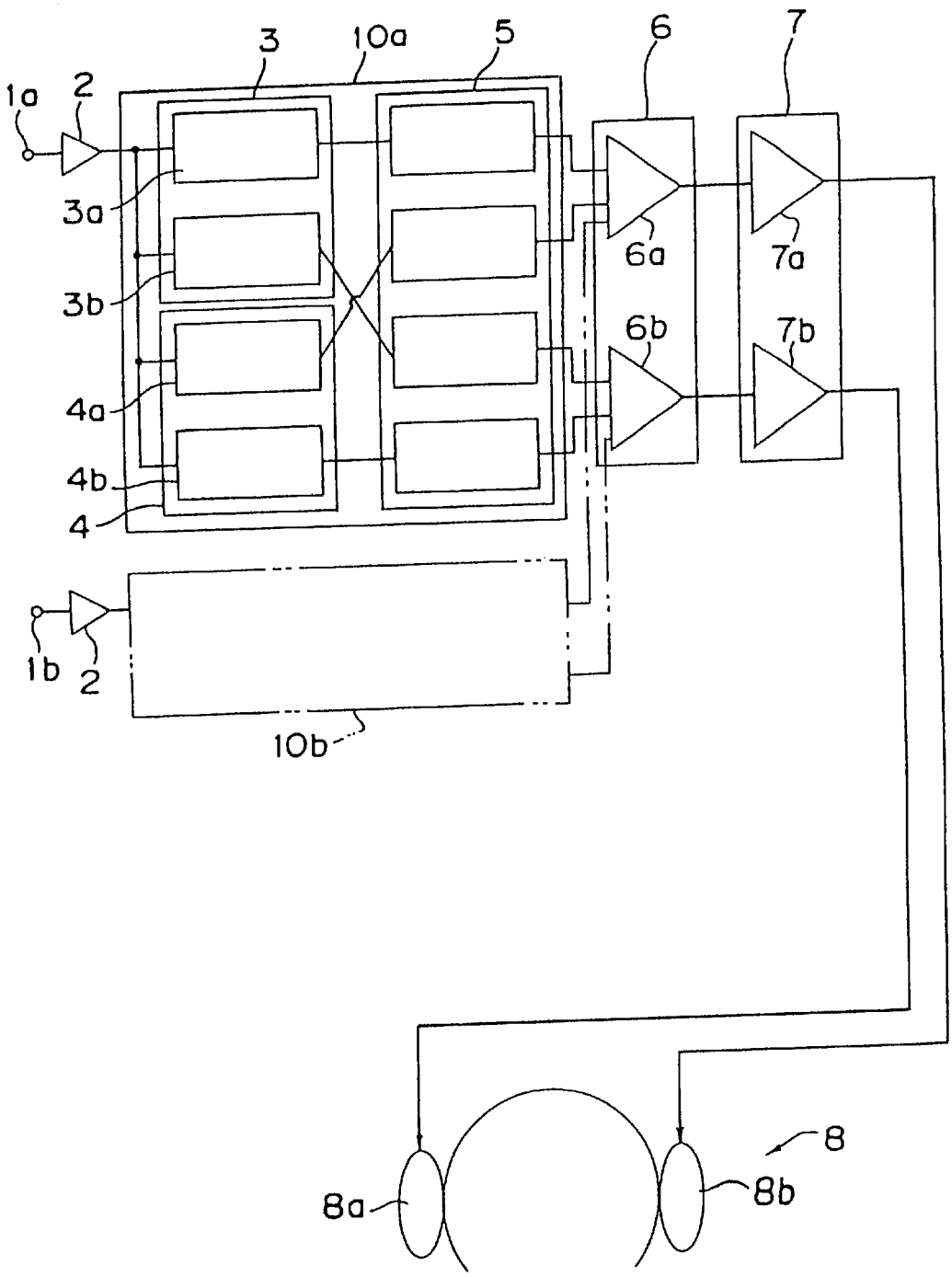
FIG. 1 is a block diagram of a headphone apparatus according to the present invention.

FIG. 1 shows a block diagram of a headphone apparatus. In this headphone apparatus, an audio signal inputted from an input terminal 1*a* is transmitted from a summing amplifier 6 (6*a*, 6*b*) and a power amplifier 7 (7*a*, 7*b*) to a headphone 8 (8*a*, 8*b*) via a buffer amplifier 2 and a unit 10*a* comprising a direct sound generator circuit 3 (3*a*, 3*b*), a reflection sound generator circuit 4 (4*a*, 4*b*) and a filter circuit 5.

The above-mentioned direct sound generator circuit 3 comprises a first direct sound generator circuit 3*a* and a second direct sound generator circuit 3*b* and generates a direct sound audio signal by delaying the audio signal inputted from the input terminal 1*a* by a specified time between both the circuits 3*a* and 3*b* as follows.

Figure 3:
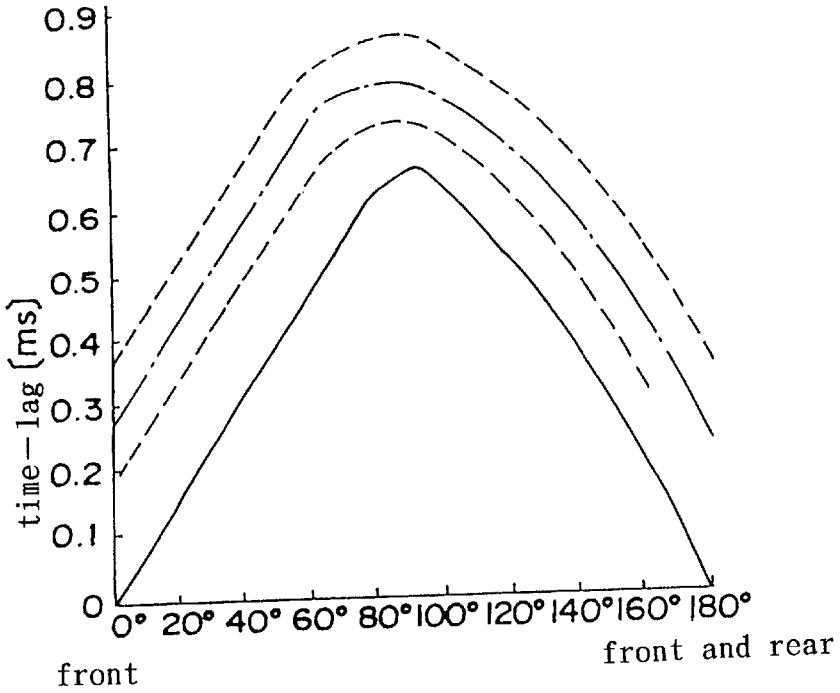
FIG. 3 is a graph showing a relationship between a position of an imaginary sound source relative to the face and a delay time to each ear.

The signals generated by the direct sound generator circuits 3*a* and 3*b* are made to have a phase shift by adjusting a delay time depending on a position in which an acoustic image is localized according to the curve of the solid line shown in the graph of FIG. 3.

The curve of the solid line shown in the graph of FIG. 3 indicates the delay time generated between left and right ears depending on a position of a sound source. No time difference exists when the sound source is located in front of the user's face, and a time difference occurs approximately in proportion to an angle of radiation as the user turns sideward, the time difference becoming about 0.7 ms just on the lateral side.

Then, the aforementioned direct sound generator circuits 3*a* and 3*b* generate respective audio signals by providing the audio signal inputted to the input terminal 1*a* with a difference in delay time.

Figure 2:
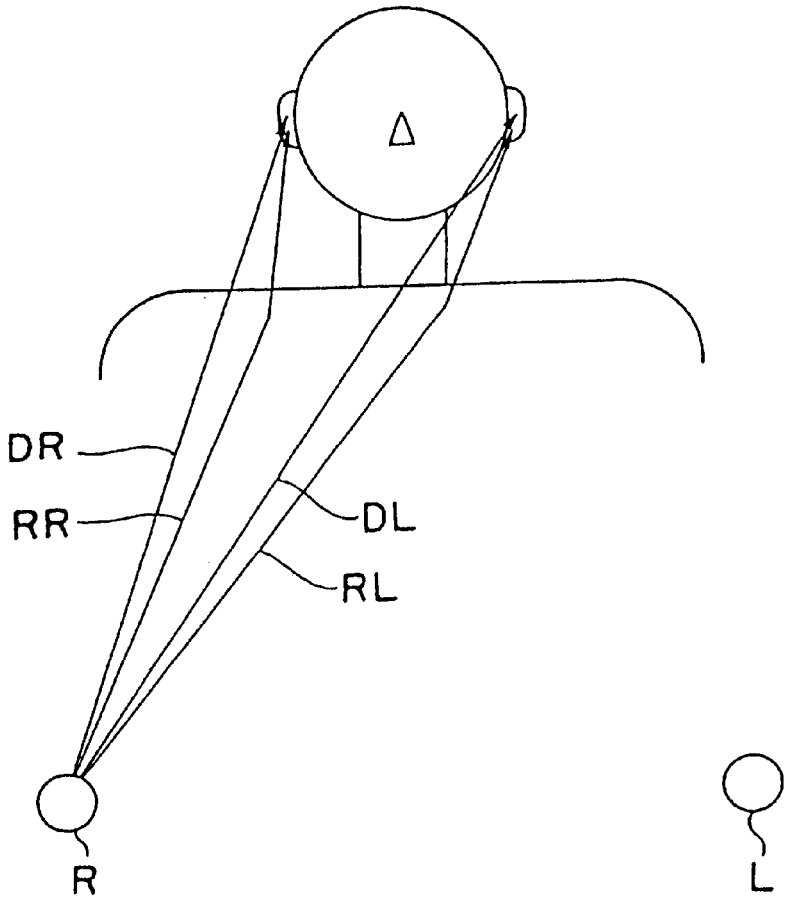
FIG. 2 is a plan view (a) and a side view (b) showing a sound traveling from an imaginary sound source to the ears.

When obtaining an imaginary sound source R by localizing an acoustic image diagonally to the front of the face as shown in FIG. 2, the first direct sound generator circuit 3*a* adjusts the delay time so that a sound corresponding to the direct sound (indicated by the solid line DR in FIG. 2) which travels from the imaginary sound source R and directly reaches the right ear can be generated. The second direct sound generator circuit 3*b* adjusts the delay time so that a sound corresponding to the direct sound (indicated by the solid line DL in FIG. 2) which travels from the imaginary sound source R and directly reaches the left ear can be generated.

The reflection sound generator circuit 4 comprises a first reflection sound generator circuit 4*a* and a second reflection sound generator circuit 4*b* and generates a reflection sound audio signal by delaying the audio signal inputted from the input terminal 1*a* by a specified time as follows.

The signals to be generated by the reflection sound generator circuits 4*a* and 4*b* are made to have a phase shift by adjusting the delay time according to the curve of the one-dot chain line shown in the graph of FIG. 3. This is because a delay time occurs due to a difference in travel distance between the direct sound and the reflection sound traveling from the sound source to each of the ears. Therefore, the curve indicated by the one-dot chain line in the graph of FIG. 3 is delayed by 0.2 to 1.0 ms relative to the curve indicated by the solid line in the graph.

Then, the reflection sound generator circuits 4*a* and 4*b* delay the audio signal inputted to the input terminal 1*a* by a specified time longer than the delay time of the corresponding direct sound generator circuits 3*a* and 3*b* to cause the signal to have the phase shift.

When obtaining the imaginary sound source R by localizing an acoustic image diagonally to the front of the face similar to the aforementioned case, the first reflection sound generator circuit 4*a* adjusts the delay time so that a sound corresponding to the reflection sound (indicated by the one-dot chain line RR in FIG. 2) which travels from the imaginary sound source R, impinges once on a user's shoulder and reaches the right ear, can be generated. The second reflection sound generator circuit 4*b* adjusts the delay time so that a sound corresponding to the reflection sound (indicated by the one-dot chain line RL in FIG. 2) which travels from the imaginary sound source R, impinges once on the user's shoulder and reaches the left ear can be generated.

If it is assumed that the position of the imaginary sound source R is fixed, then the first direct sound generating means 3*a* is not always necessary, and it is proper to set the delay times in the second direct sound generator circuit 3*b*, the first reflection sound generator circuit 4*a* and the second reflection sound generator circuit 4*b* by using the sound that travels from the imaginary sound source R and directly reaches the right ear as a reference.

The filter circuit 5 is connected to the generator circuits 3 and 4 and operates to make an appropriate sound pressure level of the audio signal to be reproduced by the headphone 8. That is, the sound pressure level of the sound reaching each of the left and right ears varies as in the graph of FIG. 4 as the sound source turns sideward from the front of the face. In this case, the sound pressure level ofthe sound reaching each ear varies little in a bass region even when the sound source moves sideward. However, the sound pressure level gradually decreases in a treble region as the sound source moves closer to the lateral side. The same thing can be said for the relationship between the direct sound and the reflection sound because they have a difference in travel time to the ear.

Accordingly, depending on the position in which the acoustic image is to be localized, the filter circuit 5 changes the sound pressure level between the first direct sound generator circuit 3*a* and the second direct sound generator circuit 3*b* among the signals inputted from the generator circuits 3 and 4.

Figure 4:
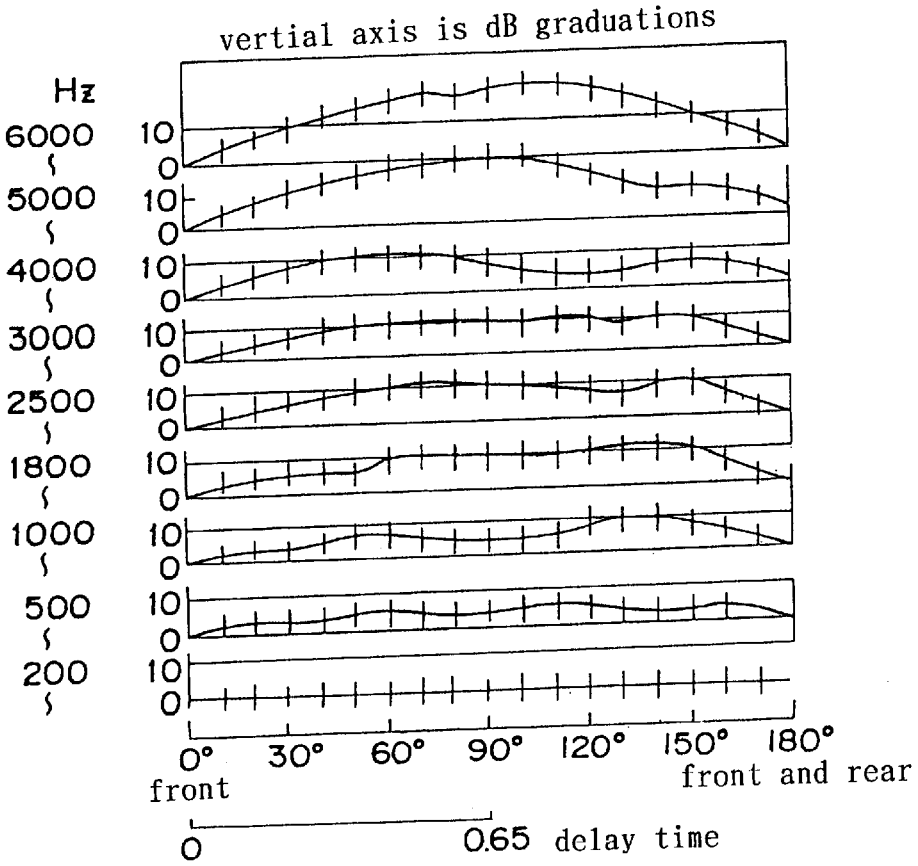
FIG. 4 is a graph showing a relationship between a position of an imaginary sound source relative to the face and a sound pressure level at each ear depending on a frequency of a sound from the imaginary sound source.

Specifically, as shown in the graph of FIG. 4, the sound pressure level at each frequency is changed depending on how many degrees of angle the acoustic image is displaced for localization from the front of the face. For example, when obtaining the imaginary sound source R with the acoustic image localized 40 degrees diagonal to the front of the face (see FIG. 2), the sound pressure level is determined as follows. When the audio signal from the first direct sound generator circuit 3*a* of a sound which directly reaches the right ear is used as a reference signal, the audio signal from the second direct sound generator circuit 3*b* of a sound which directly reaches the left ear is delayed by 0.3 ms from the reference signal. Accordingly, the sound pressure level of the audio signal is set to be −3 dB at 200 to 500 Hz, −5 dB at 500 to 1000 Hz, . . . , and −12 dB at 5000 to 6000 Hz relative to the reference signal.

The summing amplifier 6 comprises: a first summing amplifier 6*a* which adds the first direct sound component to the first reflection sound component inputted respectively from the first direct sound generator circuit 3*a* and the first reflection sound generator circuit 4*a* via the respective filter circuits 5; and a second summing amplifier 6*b* which adds the second direct sound component to the second reflection sound component inputted respectively from the second direct sound generator circuit 3*b* and the second reflection sound generator circuit 4*b* via the respective filter circuits 5.

The power amplifier 7 comprises: a first power amplifier 7*a* which amplifies a signal inputted via the first summing amplifier 6*a;* and a second power amplifier 7*b* which amplifies a signal inputted via the second summing amplifier 6*b,* operating to form outputs to the left and right headphones 8*a* and 8*b,* respectively.

As conventionally known, the headphone 8 is constructed for obtaining a desired sound by vibrating a diaphragm by magnetically exciting or erasing its magnetic circuit section or the like, and is mainly an inner ear type which is to be directly inserted into the ear hole is mainly used. When applying this apparatus to a headphone of a type which covers the whole ear, the delay time adjustment is required to be slightly modified.

In the headphone apparatus having the aforementioned construction, the audio signal inputted into the input terminal 1*a* is delayed by the specified times in the generator circuits 3 and 4. In this case, the delay times are changed so that a phase shift is provided between the first direct sound generator circuit 3*a* and the second direct sound generator circuit 3*b,* between the first direct sound generator circuit 3*a* and the first reflection sound generator circuit 4*a* and between the second direct sound generator circuit 3*b* and the second reflection sound generator circuit 4*b.*

That is, a time difference (a phase difference in the case of a continuous sound) is generated between the direct sounds which travel from the imaginary sound source and directly reach the left and right ears in the case of the first direct sound generator circuit 3*a* and the second direct sound generator circuit 3*b,* and therefore, audio signals delayed by the time difference are generated.

A time difference (a phase difference in the case of a continuous sound) is generated between the direct sound which travels from the imaginary sound source position and directly reaches the left and right ears and the reflection sound which impinges once on the user's shoulder and then indirectly reaches the left and right ears in the case of the first direct sound generator circuit 3*a* and the first reflection sound generator circuit 4*a* or in the case of the second direct sound generator circuit 3*b* and the second reflection sound generator circuit 4*b,* and therefore, audio signals delayed by the time difference are generated.

Output signals from the generator circuits 3 and 4 are inputted to the corresponding filter circuits 5 and made to have their treble components removed according to the delay times set in the generator circuits 3 and 4 and have their sound pressure levels adjusted. When the imaginary sound source is located rearward, the shapes of the ears and so forth exert a significant influence, and therefore, the sound pressure level in the treble region is further suppressed to provide a state equivalent to a state in which the sound is actually coming from behind.

In regard to the sound thus reproduced by the headphone 8, the acoustic image can be localized in a desired position by providing a delay time for the sounds reaching the left and right ears. Furthermore, the arrangement in which the sound reflected on the shoulder is taken into consideration and the sounds based on the delay time are transferred to the left and right ears, allows for the production of a sound having a greater expanse in the depthwise direction Furthermore, the arrangement in which the sound pressure level is changed according to the aforementioned delay times allows for the production of an effect of excellent directivity of the imaginary sound source obtained as a result of localizing the acoustic image.

Figure 5:
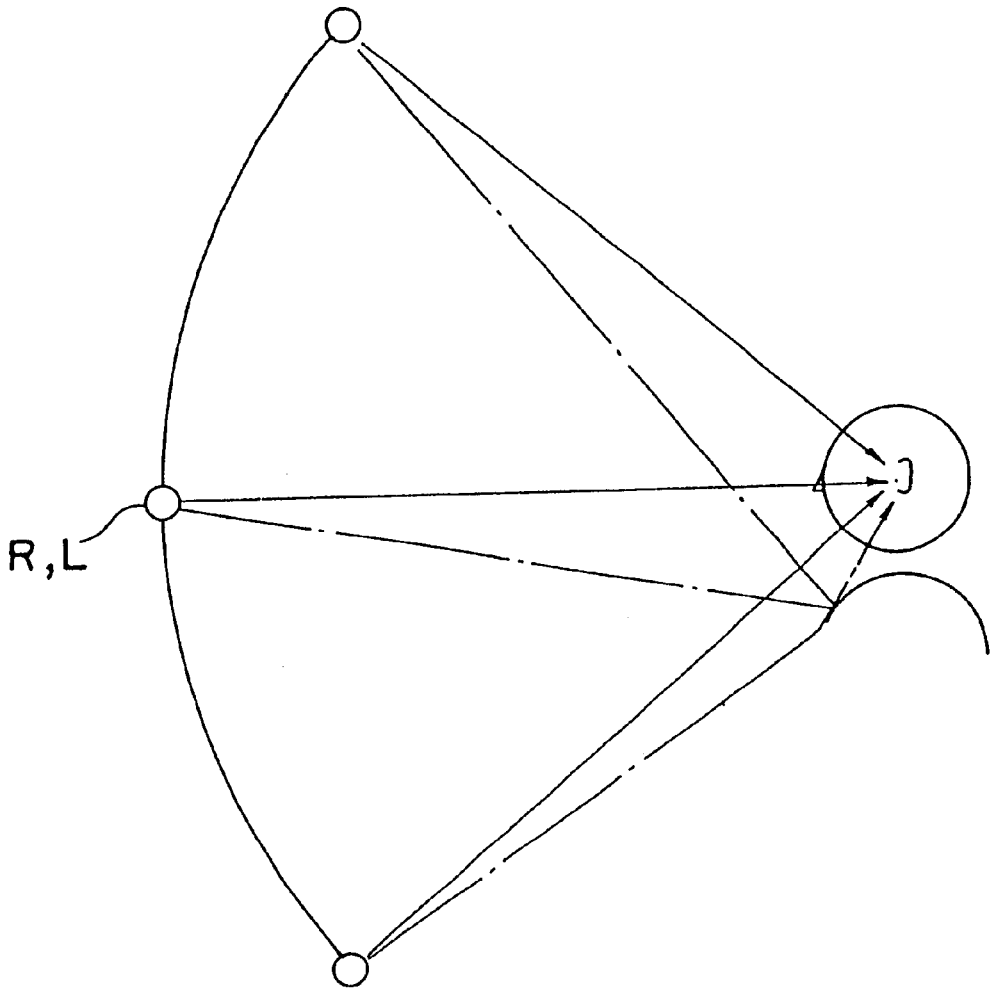
FIG. 5 is a view showing a relationship between a direct sound and a reflection sound when a position of an imaginary sound source varies in a vertical direction.

Furthermore, according to the headphone apparatus having the aforementioned construction, the acoustic image can be localized in the vertical direction by changing the delay time of the reflection sound audio signal. That is, as shown in FIG. 5, the higher the sound source position is located, the longer the travel distance of the reflection sound to the left and right ears. Therefore, by changing the delay time ofthe reflection sound, the acoustic image can be localized in the vertical direction. In this case, the delay time of the reflection sound relative to the direct sound is varied within a range of the dashed lines shown in the graph of FIG. 3. The dashed line on the lower side indicates the delay time to be set when the acoustic image is localized lower, while the dashed line on the upper side indicates the delay time to be set when the acoustic image is localized higher.

The aforementioned embodiment has been described based on the case where one imaginary sound source is set, however, it is possible to provide a so-called multi-channel arrangement in which a plurality of imaginary sound sources are set. In this case, it is proper to provide the aforementioned direct sound generator circuit 3 and the reflection sound generator circuit 4 for each imaginary sound source.

A case in which, for example, acoustic images are localized in two positions for the obtainment of imaginary sound sources R and L on left-hand and right-hand sides will be described. In this case, two input terminals 1*a* and 1*b* are provided, and units 10*a* and 10*b* are connected to the input terminals 1*a* and 1*b,* respectively. Then, signals from the first direct sound generator circuit 3*a* and the first reflection sound generator circuit 4*a* contained within the units 10*a* and 10*b* are reproduced by the headphone 8*a* on the left-hand side, while signals from the second direct sound generator circuit 3*b* and the second reflection sound generator circuit 4*b* are reproduced by the headphone 8*b* on the right-hand side (circuits corresponding to the input terminal 1*b* are not shown in FIG. 2).

Audio signals inputted from the input terminals 1*a* and 1*b* are delayed as follows in the generator circuits 3 and 4.

That is, by generating audio signals from the audio signal inputted from the input terminal 1*a* so that the delay time in the second direct sound generator circuit 3*b* is made longer than in the first direct sound generator circuit 3*a,* the imaginary sound source R is obtained with the acoustic image localized on the right-hand side.

Further, by generating audio signals from the audio signal inputted from the input terminal 1*b* so that the delay time in the first direct sound generator circuit 3*a* is made longer than in the second direct sound generator circuit 3*b,* the imaginary sound source L is obtained with the acoustic image localized on the left-hand side.

Although the case where the imaginary sound sources R and L are obtained with the acoustic images localized in two different positions has been described herein, it is acceptable to localize acoustic images in three or more different positions. For example, by inputting different audio signals of various instruments of an orchestra to corresponding input terminals and changing the delay time of every corresponding unit, sounds can be reproduced as if they were heard directly from the instruments at a live performance. This can also be applied to a case where a headphone is used for a conference in a large hall.

It is to be noted that, even when acoustic images are localized in two or more different positions as described above, the first direct sound generator circuit 3*a* is not necessary if the sound source position is fixed, similar to the case where only the aforementioned imaginary sound source R exists.

Although the extra-head localization is achievable by taking only the direct sound and the reflection sound from the sound source into consideration in the aforementioned embodiment, it is acceptable to take into consideration a diffraction sound on the face (meaning a sound which directly impinges on the face and then travels along its surface to an ear) into consideration. It is to be noted that a diffraction sound generator circuit is required in addition to the direct sound generator circuit 3 and the reflection sound generator circuit 4 in this case. As a matter of course, the diffraction sound generator circuit is required for each sound source to be imagined (imaginary sound source), and the filter circuit 5 is necessary for each diffraction sound generator circuit.

If the aforementioned diffraction sound simply overlaps with the direct sound and the reflection sound, there is a concern that the bass region (50 to 100 Hz) might be emphasized, and it is preferable to reduce the bass region to a certain extent. This can be ascribed to the fact that each sound reaching an ear has a directivity. In this case, as a method for reducing the bass region, it is proper to invert in polarity the waveform of any one of the aforementioned sounds, reduce it to a specified level via a filter circuit or the like, or take a similar measure.

It is also acceptable to take a reflection sound on a wall or the like into consideration in addition to the aforementioned direct sound as well as the reflection sound and the diffraction sound on the shoulder. That is, it is proper to set the imaginary sound source by taking into consideration how much the sound which has been reflected on the wall or the like and reaches the ear is delayed relative to the sound which travels from the sound source and directly reaches the ear and where the sound has been reflected. Specifically, it is proper to set the position of the imaginary sound source so that it is located in a mirror symmetry position with respect to the aforementioned sound source about the reflection surface of the wall or the like. As a matter of course, a sound having a concert-hall presence can be obtained by taking the reflection sound on the shoulder and the diffraction sound on the face into consideration even in the case of the reflection sound on the wall or the like.

Furthermore, the delay circuits (direct sound generator circuit 3 and reflection sound generator circuit 4) in the aforementioned embodiment may each be of analog type or digital type, and it is a matter of course that any existing conventional technique can be used so long as the desired delay time can be obtained as an essential factor. Therefore, it is acceptable to directly connect the reflection sound generator circuit 4 in series to the direct sound generator circuit 3 as opposed to the arrangement in which the direct sound generator circuit 3 and the reflection sound generator circuit 4 are provided in parallel and where audio signals are separately generated as in the aforementioned embodiment. In this case, it is proper to construct the reflection sound generator circuit 4 to generate an audio signal based on a delay time with respect to the audio signal generated by the direct sound generator circuit 3.

What is claimed is:

1. A headphone apparatus for use with first and second ears of a user, the headphone apparatus comprising:

a first direct sound generating means for generating a first direct sound audio signal corresponding to a sound which travels from an imaginary sound source and directly reaches the first ear by delaying an input audio signal;

a second direct sound generating means for generating a second direct sound audio signal corresponding to a sound which travels from the imaginary sound source and directly reaches the second ear by delaying the input audio signal;

a first reflection sound generating means for generating a first reflection sound audio signal corresponding to a sound which travels from the imaginary sound source, reaches a shoulder of the user and thereafter reaches the first ear through reflection by delaying the input audio signal;

a second reflection sound generating means for generating a second reflection sound audio signal corresponding to a sound which travels from the imaginary sound source, reaches a shoulder of the user and thereafter reaches the second ear through reflection by delaying the input audio signal;

a first adding means for adding the first direct sound audio signal to the first reflection sound audio signal, thereby generating a first combined sound audio signal;

a second adding means for adding the second direct sound audio signal to the second reflection sound audio signal, thereby generating a second combined sound audio signal; and headphones operable to reproduce the first combined sound audio signal from said first adding means and the second combined sound audio signal from the second adding means independently at the first and second ears, respectively.

2. The headphone apparatus as claimed in claim 1, wherein said first direct sound generating means, said second direct sound generating means, said first reflection sound generating means and said second reflection sound generating means are combined into a single unit.

3. The headphone apparatus as claimed in claim 1, wherein a phase shift of the first and second reflection sound audio signals relative to the first and second direct sound audio signals, respectively, is made adjustable.

4. The headphone apparatus as claimed in claim 1, further comprising a sound pressure adjusting means for suppressing a sound pressure level of the first direct sound audio signal, the second direct sound audio signal, the first reflection sound audio signal and the second reflection sound audio signal as a phase shift relative to the input audio signal, said sound pressure adjusting means is provided between said first and second direct sound generating means and said first and second adding means.

5. The headphone apparatus as claimed in claim 4, wherein said sound pressure adjusting means suppresses the sound pressure level on a treble region side of the first and second direct sound audio signals and the first and second reflection sound audio signals whose sound pressure level has been suppressed, further than that on a bass region side.

6. The headphone apparatus as claimed in claim 1, further comprising:

a first diffraction sound generating means for generating a first diffraction sound audio signal corresponding to a sound which travels from the imaginary sound source and reaches the first ear through diffraction on a face by delaying the input audio signal; and a second diffraction sound generating means for generating a second diffraction sound audio signal corresponding to a sound which travels from the imaginary sound source and reaches the second ear through diffraction on the face by delaying the input audio signal, wherein said first adding means adds the first diffraction sound audio signal to the first direct audio signal and the first reflection sound audio signal, and said second adding means adds the second diffraction sound audio signal to the second direct audio signal and the second reflection sound audio signal.

7. A headphone apparatus for use with headphones for first and second ears of a user, the headphone apparatus comprising:

a first direct sound generating means for generating a first direct sound audio signal corresponding to a sound which travels from an imaginary sound source and directly reaches the first ear by delaying an input audio signal;

a second direct sound generating means for generating a second direct sound audio signal corresponding to a sound which travels from the imaginary sound source and directly reaches the second ear by delaying the input audio signal;

a first reflection sound generating means for generating a first reflection sound audio signal corresponding to a sound which travels from the imaginary sound source reaches a shoulder and thereafter reaches the first ear through reflection by delaying the input audio signal;

a second reflection sound generating means for generating a second reflection sound audio signal corresponding to a sound which travels from the imaginary sound source reaches a shoulder and thereafter reaches the first ear through reflection by delaying the input audio signal;

a first adding means for adding the first direct sound audio signal to the first reflection sound audio signal, thereby generating a first combined sound audio signal for supply to the first ear via the headphones; and a second adding means for adding the second direct sound audio signal to the second reflection sound audio signal, thereby generating a second combined sound audio signal for supply to the second ear via the headphones.

8. The headphone apparatus as claimed in claim 7, wherein said first direct sound generating means, said second direct sound generating means, said first reflection sound generating means and said second reflection sound generating means are combined into a single unit.

9. The headphone apparatus as claimed in claim 7, wherein a phase shift of the first and second reflection sound audio signals relative to the first and second direct sound audio signals, respectively, is made adjustable.

10. The headphone apparatus as claimed in claim 7, further comprising a sound pressure adjusting means for suppressing a sound pressure level of the first direct sound audio signal, the second direct sound audio signal, the first reflection sound audio signal and the second reflection sound audio signal as a phase shift relative to the input audio signal, said sound pressure adjusting means is provided between said first and second direct sound generating means and said first and second adding means.

11. The headphone apparatus as claimed in claim 10, wherein said sound pressure adjusting means suppresses the sound pressure level on a treble region side of the first and second direct sound audio signals and the first and second reflection sound audio signals whose sound pressure level has been suppressed, further than that on a bass region side.

12. The headphone apparatus as claimed in claim 7, further comprising:

a first diffraction sound generating means for generating a first diffraction sound audio signal corresponding to a sound which travels from the imaginary sound source and reaches the first ear through diffraction on a face by delaying the input audio signal; and a second diffraction sound generating means for generating a second diffraction sound audio signal corresponding to a sound which travels from the imaginary sound source and reaches the second ear through diffraction on the face by delaying the input audio signal, wherein said first adding means adds the first diffraction sound audio signal to the first direct audio signal and the first reflection sound audio signal, and said second adding means adds the second diffraction sound audio signal to the second direct audio signal and the second reflection sound audio signal.

13. A headphone apparatus for use with first and second ears of a user, the headphone apparatus comprising:

one first direct sound generating means for generating one first direct sound audio signal corresponding to a sound which travels from one imaginary sound source and directly reaches the first ear by delaying one input audio signal;

one second direct sound generating means for generating one second direct sound audio signal corresponding to a sound which travels from the one imaginary sound source and directly reaches the second ear by delaying the one input audio signal;

one first reflection sound generating means for generating one first reflection sound audio signal corresponding to a sound which travels from the one imaginary sound source, reaches a shoulder of the user and thereafter reaches the first ear through reflection by delaying the one input audio signal;

one second reflection sound generating means for generating one second reflection sound audio signal corresponding to a sound which travels from the one imaginary sound source, reaches a shoulder of the user and thereafter reaches the second ear through reflection by delaying the one input audio signal;

another first direct sound generating means for generating another first direct sound audio signal corresponding to a sound which travels from another imaginary sound source and directly reaches the first ear by delaying another input audio signal;

another second direct sound generating means for generating another second direct sound audio signal corresponding to a sound which travels from the another imaginary sound source and directly reaches the second ear by delaying the another input audio signal;

another first reflection sound generating means for generating another first reflection sound audio signal corresponding to a sound which travels from the another imaginary sound source, reaches a shoulder of the user and thereafter reaches the first ear through reflection by delaying the another input audio signal;

another second reflection sound generating means for generating another second reflection sound audio signal corresponding to a sound which travels from the another imaginary sound source, reaches a shoulder of the user and thereafter reaches the second ear through reflection by delaying the another input audio signal;

a first adding means for adding the one first direct sound audio signal, the another first direct sound audio signal, the one first reflection sound audio signal and the another first reflection sound audio signal, thereby generating a first combined sound audio signal;

a second adding means for adding the one second direct sound audio signal, the another second direct sound audio signal, the one second reflection sound audio signal and the another second reflection sound audio signal, thereby generating a second combined sound audio signal; and headphones operable to reproduce the first combined sound audio signal from said first adding means and the second combined sound audio signal from the second adding means independently at the first and second ears, respectively.

14. The headphone apparatus as claimed in claim 13, wherein said one first direct sound generating means, said one second direct sound generating means, said one first reflection sound generating means and said one second reflection sound generating means are combined into a first unit and said another first direct sound generating means, said another second direct sound generating means, said another first reflection sound generating means and said another second reflection sound generating means are combined into a second unit.

15. A headphone apparatus for use with headphones for first and second ears of a user, the headphone apparatus comprising:

one first direct sound generating means for generating one first direct sound audio signal corresponding to a sound which travels from one imaginary sound source and directly reaches the first ear by delaying one input audio signal;

one second direct sound generating means for generating one second direct sound audio signal corresponding to a sound which travels from the one imaginary sound source and directly reaches the second ear by delaying the one input audio signal;

one first reflection sound generating means for generating one first reflection sound audio signal corresponding to a sound which travels from the one imaginary sound source, reaches a shoulder of the user and thereafter reaches the first ear through reflection by delaying the one input audio signal;

one second reflection sound generating means for generating one second reflection sound audio signal corresponding to a sound which travels from the one imaginary sound source, reaches a shoulder of the user and thereafter reaches the second ear through reflection by delaying the one input audio signal;

another first direct sound generating means for generating another first direct sound audio signal corresponding to a sound which travels from another imaginary sound source and directly reaches the first ear by delaying another input audio signal;

another second direct sound generating means for generating another second direct sound audio signal corresponding to a sound which travels from the another imaginary sound source and directly reaches the second ear by delaying the another input audio signal;

another first reflection sound generating means for generating another first reflection sound audio signal corresponding to a sound which travels from the another imaginary sound source, reaches a shoulder of the user and thereafter reaches the first ear through reflection by delaying the another input audio signal;

another second reflection sound generating means for generating another second reflection sound audio signal corresponding to a sound which travels from the another imaginary sound source, reaches a shoulder of the user and thereafter reaches the second ear through reflection by delaying the another input audio signal;

a first adding means for adding the one first direct sound audio signal, the another first direct sound audio signal, the one first reflection sound audio signal and the another first reflection sound audio signal, thereby generating a first combined sound audio signal for supply to the first ear via the headphones; and a second adding means for adding the one second direct sound audio signal, the another second direct sound audio signal, the one second reflection sound audio signal and the another second reflection sound audio signal, thereby generating a second combined sound audio signal for supply to the second ear via the headphones.

16. The headphone apparatus as claimed in claim 15, wherein said one first direct sound generating means, said one second direct sound generating means, said one first reflection sound generating means and said one second reflection sound generating means are combined into a first unit and said another first direct sound generating means, said another second direct sound generating means, said another first reflection sound generating means and said another second reflection sound generating means are combined into a second unit.

* * * * *